US008697616B2

(12) United States Patent
Xu et al.

(10) Patent No.: US 8,697,616 B2
(45) Date of Patent: Apr. 15, 2014

(54) ORGANIC MOLYBDENUM ADDITIVE, ITS PREPARATION METHOD, A LUBRICATING COMPOSITION CONTAINING SAID ADDITIVE, AND USE OF THE SAME

(75) Inventors: Wei Xu, Beijing (CN); Kecheng Wei, Beijing (CN); Qinghua Duan, Beijing (CN); Fuhui Zhang, Beijing (CN)

(73) Assignees: China Petroleum & Chemical Corporation, Beijing (CN); Research Institute of Petroleum Processing, Sinopec, Beijing (CN)

( * ) Notice: Subject to any disclaimer, the term of this patent is extended or adjusted under 35 U.S.C. 154(b) by 1264 days.

(21) Appl. No.: 12/281,120

(22) PCT Filed: Feb. 28, 2007

(86) PCT No.: PCT/CN2007/000638

§ 371 (c)(1),
(2), (4) Date: Dec. 2, 2008

(87) PCT Pub. No.: WO2007/098695

PCT Pub. Date: Sep. 7, 2007

(65) Prior Publication Data

US 2009/0156443 A1 Jun. 18, 2009

(30) Foreign Application Priority Data

Feb. 28, 2006 (CN) ..... 2006 1 0008072

(51) Int. Cl.
*C10M 159/18* (2006.01)
*C10M 169/04* (2006.01)

(52) U.S. Cl.
USPC ..... 508/165; 508/221; 508/452; 556/57

(58) Field of Classification Search
USPC ..... 508/221, 166, 170, 165, 452; 556/57
See application file for complete search history.

(56) References Cited

U.S. PATENT DOCUMENTS

| | | | | |
|---|---|---|---|---|
| 4,201,683 | A | 5/1980 | Brewster | |
| 4,266,945 | A * | 5/1981 | Karn | 44/367 |
| 4,692,256 | A * | 9/1987 | Umemura et al. | 508/362 |
| 4,889,647 | A | 12/1989 | Rowan et al. | |
| 5,137,647 | A | 8/1992 | Karol | |
| 5,412,130 | A | 5/1995 | Karol | |
| 6,046,263 | A | 4/2000 | Rasberger et al. | |
| 6,103,674 | A | 8/2000 | Nalesnik et al. | |
| 6,242,393 | B1 * | 6/2001 | Ishida et al. | 508/462 |

FOREIGN PATENT DOCUMENTS

| | | | |
|---|---|---|---|
| CN | 1198907 | C | 4/2005 |
| CN | 200610008072.6 | * | 2/2006 |
| EP | 1 136 496 | A1 | 9/2001 |
| EP | 1 136 497 | A1 | 9/2001 |
| JP | 2000192066 | A | 7/2000 |
| JP | 2004211006 | A | 7/2004 |

OTHER PUBLICATIONS

Supplementary European Search Report dated Jul. 21, 2010.

* cited by examiner

*Primary Examiner* — Jim Goloboy
(74) *Attorney, Agent, or Firm* — Scully, Scott, Murphy & Presser, P.C.

(57) ABSTRACT

The present invention relates to an organic molybdenum additive and its preparation method, and a lubricating composition comprising said additive, and use of said additive and its lubricating composition in the aspect of improving antiwear and antifriction property of oil products. The organic molybdenum additive according to the present invention is characterized in that it is prepared by reacting several kinds of feedstock as follows: a polylol ester of p-hydroxybenzene alkyl acid, an inorganic molybdenum compound and an aliphatic amine and/or an aromatic amine and/or an amide. The organic molybdenum additive of the present invention has excellent antiwear and/or antifriction property.

27 Claims, 3 Drawing Sheets

ORGANIC MOLYBDENUM ADDITIVE, ITS PREPARATION METHOD, A LUBRICATING COMPOSITION CONTAINING SAID ADDITIVE, AND USE OF THE SAME

TECHNICAL FIELD

The present invention relates to an organic molybdenum additive and the preparation method thereof, a lubricating composition containing said additive, and use of said additive or said lubricating composition containing said additive in the aspect of improving properties of antiwear and antifriction

BACKGROUND ART

Along with environmental protection laws being increasingly rigorous and requirement of saving energy being higher and higher, engine manufacturers make continuously engine size reduced, compression ratio increased and motor operation temperature elevated, and thus fuel utilization improved, energy resource saved and waste gas emission reduced. In the meanwhile, the lubricant oil is also required to have better properties of antiwear and antifriction. These all propose higher requirement of lubricants in properties of antiwear, antifriction and antioxidant.

Phosphor contained in lubricant oil may shorten effective life of the catalyst in tail-gas converter of automobile, and sulfur contained in the lubricant oil is incompatible with an elastomer sealing element and corrosive. Therefore, an organic molybdenum additive having no sulfur and no phosphor can be applied to lubricant oils with high grade and high standard and has more broad applicability.

U.S. Pat. No. 4,692,256 discloses an organic molybdenum lubricant additive having properties of antiwear, antifriction and antioxidation.

U.S. Pat. No. 4,889,647 discloses an organic molybdenum lubricant additive prepared by reacting a fatty oil and diethanolamine with an inorganic molybdenum compound, said additive has properties of antiwear and antifriction, and is commercially avaiablein a name of model No.855 by VANDERBILT.

U.S. Pat. No. 5,137,647 discloses an organic molybdenum lubricant additive prepared by reacting a fatty oil or acid and 2-(2-amino ethyl) aminoethanol with an inorganic molybdenum compound, said additive has properties of antiwear, antifriction and antioxidation and the like.

U.S. Pat. No. 5,412,130 discloses a process for preparing an organic molybdenum lubricant additive by reacting a diol, a diamine, a thiol and an aminoethanol with an inorganic molybdenum compound.

U.S. Pat. No. 6,046,263 discloses a multifunction lubricant additive having combined properties of antiwear, antifriction and antioxidation, commercially available in a name of model No. F10A by CIBA Corp.

However, in the prior art, some no-sulfur and no-phosphor lubricant additive products are superior in antiwear property, but inferior in antifriction property; or superior in antifriction property, but inferior in antiwear property; Or some may mainly take effect under condition of mixed lubrication, and some may take effect under condition of boundary lubrication. Therefore to develop a lubricant additive with even better properties of antiwear and antifriction still is an exertive direction for one skilled in the art.

CONTENTS OF THE INVENTION

One object of the present invention is to provide an organic molybdenum additive different from that in the prior art with better properties of antiwear and antifriction, said organic molybdenum additive is prepared by reacting three kinds of materials as follows:

a. A polylol ester of p-hydroxybenzene alkyl acid
b. An inorganic molybdenum compound; and
c. An aliphatic amine, an aromatic amine, an amide or the mixture thereof.

Said polylol ester of p-hydroxybenzene alkyl acid refers to a polylol ester of p-hydroxybenzene alkyl acid having shielded phenol antioxidant group.

Another object of the present invention is to provide a preparation method of aforementioned organic molybdenum additive, comprising reacting aforementioned reactants a, b and c.

Another further object of the present invention is to provide a lubricant composition containing aforementioned organic molybdenum additive together with further lubrication base oil.

Again additional object of the present invention is to provide the use of aforementioned organic molybdenum additive and the lubricating composition containing said additive in engine lubricating oil, gear oil, hydraulic oil or oils for metal working, and grease, in particular the use in said oil products and greases for improving property of antiwear and/or antifriction.

MODE OF CARRYING OUT THE INVENTION

Figure 1:
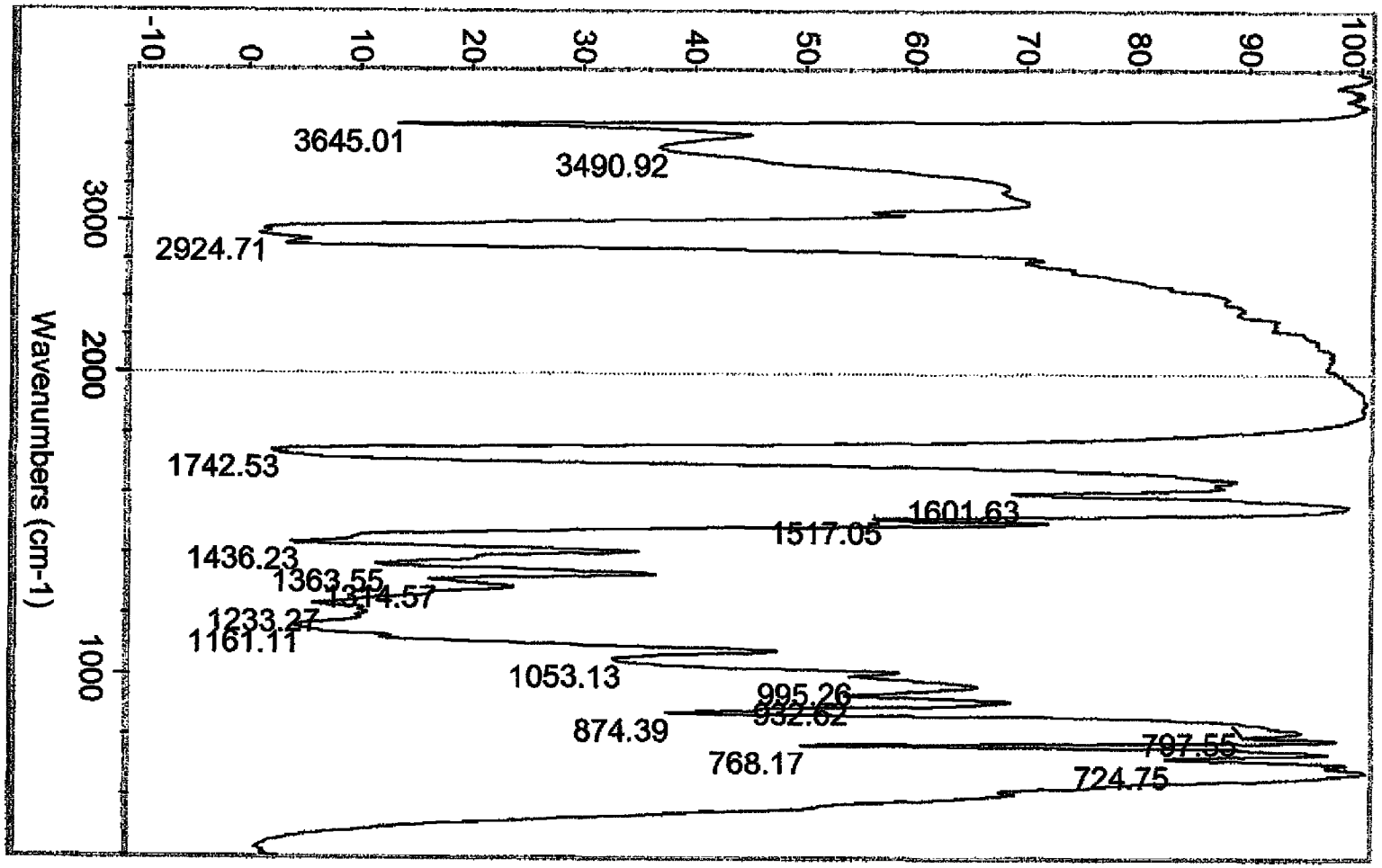
FIG. 1: An infrared spectrum of the organic molybdenum additive M-02 prepared in Example I of the present invention is shown.
Figure 2:
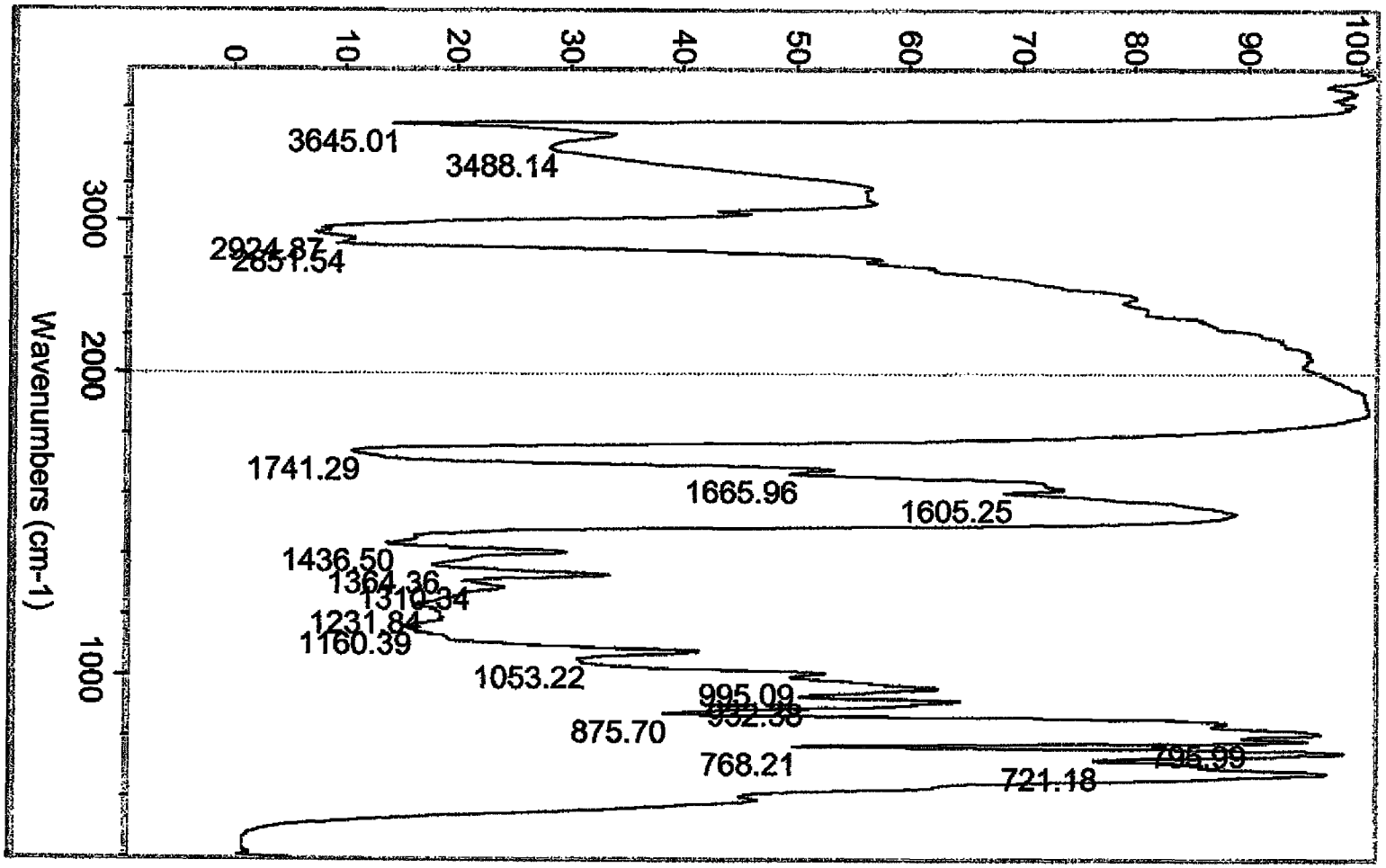
FIG. 2: An infrared spectrum of the organic molybdenum additive M-05 prepared in Example 4 of the present invention is shown.
Figure 3:
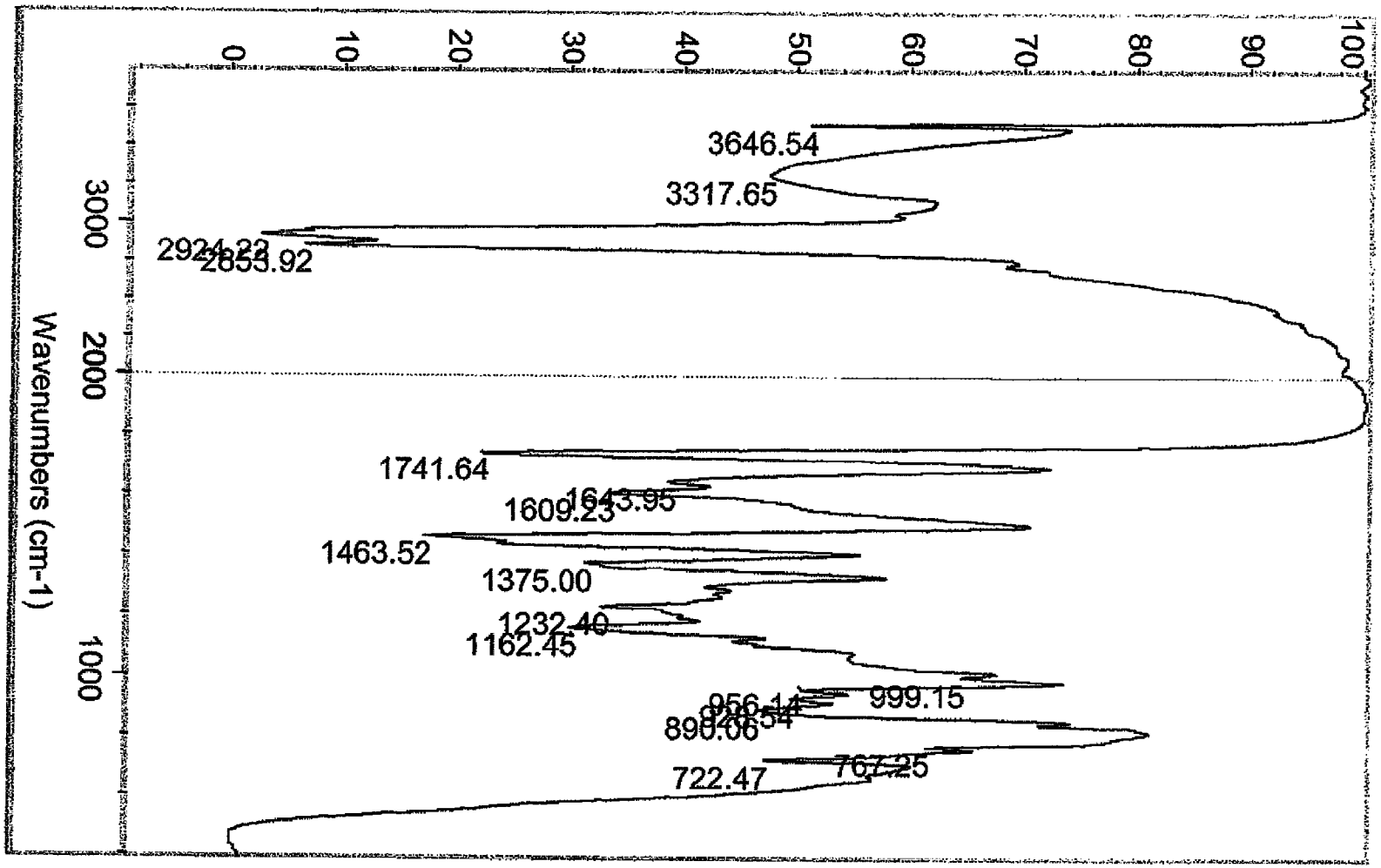
FIG. 3: An infrared spectrum of the organic molybdenum additive M-07 prepared in Example 6 of the present invention is shown.

The singular forms "a", "an", and "the" include plural referents unless the context clearly dictates otherwise.

The organic molybdenum additive of the present invention is prepared by reacting the three kinds of materials as follows:

a. A polylol ester of p-hydroxybenzene alkyl acid;
b. An inorganic molybdenum compound; and
c. An aliphatic amine, an aromatic amine, an amide or the mixture thereof.

Said polylol ester of p-hydroxybenzene alkyl acid refers to a polylol ester of p-hydroxybenzene alkyl acid having shielded phenol antioxidant group, wherein the carbon atom number of tile polylol is between 2-12 and the hydroxyl number is between 2-5. Said polylol ester of p-hydroxybenzene alkyl acid has preferably a general formula as follows:

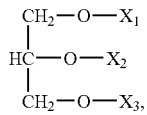

(I)

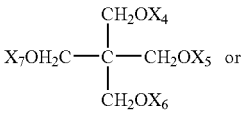

(II)

-continued (III)

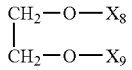

Wherein at least one of $X_1$, $X_2$ and $X_3$ is a group represented by structural formula (a), at least one of $X_4$, $X_5$, $X_6$ and $X_7$ is a group represented by structural formula (a), at least one of $X_8$ and $X_9$ is a group represented by structural formula (a), the remaining groups may be die same or different, and may be independently selected from H atom, group represented by structural formula (a) and group represented by structural formula (b), (a)

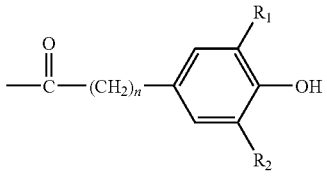

(b)

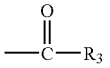

Wherein $R_1$ and $R_2$ may be the same or different, and independently selected from alkyl having a carbon atom number between 1~4, preferably tert-butyl; n is an integer number of 2~12, preferably 2~8, most preferably 2, 3 or 4; $R_3$ is 11 atom or a saturated or unsaturated hydrocarbyl group having a carbon atom number between 1~30, preferably 5~20, and most preferably 10~18.

Preferred material with aforementioned general formula (I), (II) and (III) is one selected from the group consisting of: mono glyceride compound of 3,5-di-tert-butyl p-hydroxybenzene propionic acid (a compound of structural formula I, wherein, one of groups $X_1$, $X_7$ and $X_3$ is selected from the group represented by structural formula (a) in which n is 2 and both $R_1$ and $R_2$ are tert-butyl, and each of the remaining groups in $X_1$, $X_2$ and $X_3$ is independently selected from H), diglyceride of 3,5-di-tert-butyl p-hydroxybenzene propionic acid (a compound of structural formula 1, wherein, two of croups $X_1$, $X_2$ and $X_3$ are selected from the group represented by structural formula (a) in which n is 2 and are $R_1$ and $R_2$ are tert-butyl, and the remaining group in $X_1$, $X_7$ and $X_3$ is selected from H), triglyceride of 3,5-di-tert-butyl p-hydroxybenzene propionic acid (a compound of structural formula I, wherein $X_1$, $X_2$ and $X_3$ are all selected from group represented by structural formula (a) in which n is 2 and both $R_1$ and $R_2$ are tert-butyl), mono pentaerythritol ester of 3,5-di-tert-butyl p-hydroxybenzene propionic acid (a compound of structural formula II, wherein, one of groups $X_4$, $X_5$, $X_6$ and $X_7$ is selected from the group represented by structural formula (a) in which n is 2 and both $R_1$ and $R_2$ are tert-butyl, and the remaining groups in $X_4$, $X_5$, $X_6$ and $X_7$ are selected from H), pentaerythritol diester of 3,5-di-tert-butyl p-hydroxybenzene propionic acid (a compound of structural formula II, wherein, two of groups $X_4$, $X_5$, $X_6$ and $X_7$ are selected from the group represented by structural formula (a) in which n is 2 and both $R_1$ and $R_2$ are tert-butyl, and the remaining groups in $X_4$, $X_5$, $X_6$ and $X_7$ are selected from H), pentaeryhritol triester of 3,5-di-tert-butyl p-hydroxybenzene propionic acid (a compound of structural formula (II), wherein, three of groups $X_4$, $X_5$, $X_6$ and $X_7$ are selected from the group represented by structural formula (a) in which n is 2 and both $R_1$ and $R_2$ are tert-butyl, and the remained group in $X_4$, $X_5$, $X_6$ and $X_7$ is selected from H), pentaerythritol tetraester of 3,5-di-tert-butyl p-hydroxybenzene propionic acid (a compound of structural formula II, wherein all groups of $X_4$, $X_5$, $X_6$ and $X_7$ are the group represented by structural formula (a) in which n is 2 and both $R_1$ and $R_2$ are tert-butyl), monoethyleneglycol ester of 3,5-di-tert-butyl p-hydroxybenzene propionic acid (a compound of structural formula III, wherein one of groups $X_8$ and $X_9$ is selected from the group represented by structural formula (a) in which n is 2 and both $R_1$ and $R_2$ are tert-butyl, and the remained group in $X_8$ and $X_9$ is selected from H), ethylene glycol diester of 3,5-di-tert-butyl p-hydroxybenzene propionic acid (a compound of structural formula III, wherein both $X_8$ and $X_9$ are the group represented by structural formula (a) in which n is 2 and both $R_1$ and $R_2$ are tert-butyl), diglyceride of 3,5-di-tert-butyl p-hydroxybenzene propionic acid and oleic acid (a compound of structural formula I, wherein one of groups $X_1$, $X_2$ and $X_3$ is selected from the group represented by structural formula (a) in which n is 2 and both $R_1$ and $R_2$ are tert-butyl, another group in $X_1$, $X_2$ and $X_3$ is selected from oleoyl group represented by structural formula (b)), diglyceride of 3,5-di-tert-butyl p-hydroxybenzene propionic acid and stearic acid, diglyceride of 3,5-di-tert-butyl p-hydroxybenzene propionic acid and lauric acid, diglyceride of 3,5-di-tert-butyl p-hydroxybenzene propionic acid and myristic acid, diglyceride of lauric acid, diglyceride of 3,5-di-tert-butyl p-hydroxybenzene propionic acid and palmitic acid, triglyceride of 3,5-di-tert-butyl p-hydroxybenzene propionic acid and oleic acid and stearic acid (a compound of structural formula I, wherein, $X_1$, $X_2$ and $X_3$ are respectively selected from the group of structural formula (a) in which n is 2 and both $R_1$ and $R_2$ are tert-butyl, oleoyl group of structural formula (b) and stearyl group of structural formula (b)), triglyceride of 3,5-di-tert-butyl p-hydroxybenzene propionic acid and distearic acids (a compound of structural formula I, wherein one of groups $X_1$, $X_2$ and $X_3$ is selected from the group of structural formula (a) in which n is 2 and both $R_1$ and $R_2$ are tert-butyl, and the other two groups in $X_1$, $X_2$ and $X_3$ are selected from stearyl group of structural formula (b)), triglyceride of 3,5-di-tert-butyl p-hydroxybenzene propionic acid and dilauric acids, triglyceride of 3,5-di-tert-butyl p-hydroxybenzene propionic acid and dipalmitic acids, triglyceride of 3,5-di-tert-butyl p-hydroxybenzene propionic acid, lauric acid and stearic acid (a compound of structural formula 1, wherein $X_1$, $X_2$ and $X_3$ are selected respectively from the group of structural formula (a) in which n is 2 and both $R_1$ and $R_2$ are tert-butyl, lauroyl group of structural formula (b) and stearyl group of structural formula (b)), triglyceride of 3,5-di-tert-butyl p-hydroxybenzene propionic acid, palmitic acid and stearic acid, triglyceride of 3,5-di-tert-butyl p-hydroxybenzene propionic acid, myristic acid and stearic acid, pentaerythritol diester of 3,5-di-tert-butyl p-hydroxybenzene propionic acid and oleic acid (a compound of structural formula II, wherein, two of groups $X_4$, $X_5$, $X_6$ and $X_7$ are selected respectively from the group of structural formula (a) in which n is 2 and both $R_1$ and $R_2$ are tert-butyl, and oleoyl group of structural formula (b), and the other two of groups $X_1$, $X_5$, $X_6$ and $X_7$ are selected from H), pentaerythritol diester of 3,5-di-tert-butyl p-hydroxybenzene propionic acid and stearic acid, pentaerythritol diester of 3,5-di-tert-butyl p-hydroxybenzene propionic acid and lauric acid, pentaerythritol diester of 3,5-di-tert-butyl p-hydroxybenzene propionic acid and myristic acid, pentaerythritol diester of 3,5-di-tert-butyl p-hydroxybenzene propionic acid and palmitic acid, pentaerythritol triester of 3,5-di-tert-butyl p-hydroxybenzene propionic acid, lauric acid and stearic acid (a compound of structural formula II, wherein three of groups $X_4$, $X_5$, $X_6$ and $X_7$ are respectively selected from the group of structural formula (a) in which n is 2 and both $R_1$ and $R_2$ are tert-butyl group, lauroyl group of structural formula (b) and stearyl group of structural formula (b), and another group in $X_4$, $X_5$, $X_6$ and $X_7$ is selected from H), pentaerythritol triester of 3,5-di-tert-butyl p-hydroxybenzene propionic acid, oleic acid and stearic acid, pentaerythritol triester of 3,5-di-tert-butyl p-hydroxybenzene propionic acid, palmitic acid and stearic acid, pentaerythritol triester of 3,5-di-tert-butyl p-hydroxybenzene propionic acid and distearic acids (a compound of structural formula II, wherein one of groups $X_4$, $X_5$, $X_6$ and $X_7$ is selected from the group of structural formula (a) in which n is 2 and both $R_1$ and $R_2$ are tert-butyl group, other two groups in $X_4$, $X_5$, $X_6$ and $X_7$ are selected from stearyl group of structural formula (b), and another one of groups $X_4$, $X_5$, $X_6$ and $X_7$ is selected from H), pentaerythritol tetraester of 3,5-di-tert-butyl p-hydroxybenzene propionic acids, oleic acid and distearic acids (a compound of structural formula II, wherein one of groups $X_4$, $X_5$, $X_6$ and $X_7$ is selected from the group of structural formula (a) in which n is 2 and both $R_1$ and $R_2$ are tert-butyl, other two groups in $X_4$, $X_5$, $X_6$ and $X_7$ are selected from stearyl group of structural formula (b), and another group in $X_4$, $X_5$, $X_6$ and $X_7$ is oleoyl group of structural formula (b)), ethyleneglycol ester of 3,5-di-tert-butyl p-hydroxybenzene propionic acid and stearic acid (a compound of structural formula III, wherein one of groups $X_8$ and $X_9$ is selected from the group of structural formula (a) in which n is 2 and both $R_1$ and $R_2$ are the tert-butyl group and the other group in $X_8$ and $X_9$ is selected from stearyl group of structural formula (b), and the mixture thereof.

Said inorganic molybdenum compound is one selected from the group consisting of ammonium molybdate, ammonium paramolybdate, sodium molybdate, molybdenum trioxide and the mixture thereof.

Said aliphatic amine is one selected from the group consisting of primary; secondary, tertiary amine or alkylene diamine having a carbon atom number of 4~30, an amino number between 1~5 and the mixture thereof. Preferred aliphatic amine is one selected from the group consisting of primary, secondary, tertiary aliphatic amine having a carbon atom number of 4~25 and an amino number between 1~4 and mono alkylated alkylene diamine derived from a fatty acid having a carbon atom number of 12~18, and the mixture thereof The most preferred aliphatic amine is one selected from the group consisting of butylamine, hexylamine, octylamine, laurylamine, hexadecylamine, octadecyamine, dibutylamine, diamylamine, dihexylamine, dodecyl ethylene diamine, dodecyl trimethylene diamine, cetyl ethylene diamine, cetyl trimethylene diamine, octadecyl ethylene diamine, octadecyl trimethylene diamine, coco trimethylene diamine, tallow trimethylene diamine, oleyl trimethylene diamine, N,N-dimethyl lauryl amine, N,N-dimethyl cetylamine, N,N-dimethyl stearyl amine, and the mixture thereof.

Said aromatic amine is one selected from the group consisting of aromatic amine in which aromatic ring has a side chain with a carbon atom number of 0~30 and an amino number of 1~5, or the mixture thereof. Preferred is diphenylamines, in which the aromatic ring has a side chain with a carbon atom number of 4~20 and an amino number of 1~4, alkylated diphenylamines and the mixture thereof. The most preferred is the alkylated diphenylamine in which the aromatic ring has a side chain with a carbon atom number of 4-8, the alkylated diphenylamine in which the aromatic ring has a side chain with a carbon atom number of 9-10, and the mixture thereof. Said amide is one selected from the group consisting of amide prepared by reacting a fatty acid having a carbon atom number between 1~30, especially between 12~18, with an organic amine having an amino number between 1~5 and a carbon atom number between 1~12 or aqua ammonia. Said amide is preferably one prepared by reacting a fatty acid having a carbon atom number between 1~30, especially between 12~18, with an organic amine having an amino number between 1~5 and carbon atom number between 1~12 in a molar ratio of 2:1~1:2, wherein the organic amine is preferably one selected from the group consisting of diethanolamine, hydroxyethyl ethylene diamine, diethylene triamine, triethylene tetramine, tetraethylene pentamine, dipropylene triamine, tripropylene tetramine, tetrapropylene pentamine and the mixture thereof. The most preferred amide is one selected from the group consisting of stearyl amide obtained by reacting stearic acid with diethanolamine, stearyl amide obtained by reacting stearic acid with hydroxyethyl ethylene diamine, stearyl amide obtained by reacting stearic acid with diethylene triamine, stearyl amide obtained by reacting stearic acid with triethylene tetramine, oleic acid amide obtained by reacting oleic acid with diethanolamine, oleic acid amide obtained by reacting oleic acid with hydroxyethyl ethylene diamine, oleic acid amide obtained by reacting oleic acid with diethylene triamine, oleic acid amide obtained by reacting oleic acid with triethylene tetramine, palmityl amide obtained by reacting palmitic acid with diethanolamine, palmityl amide obtained by reacting palmitic acid with hydroxyethyl ethylene diamine, palmityl amide obtained by reacting palmitic acid with diethylene triamine, palmityl amide obtained by reacting palmitic acid with triethylene tetramine, myristyl amide obtained by reacting myristic acid with diethanolamine, myristyl amide obtained by reacting myristic acid with hydroxyethyl ethylene diamine, myristyl amide obtained by reacting myristic acid with diethylene triamine, myristyl amide obtained by reacting myristic acid with triethylene tetramine, lauryl amide obtained by reacting lauric acid with diethanolamine, lauryl amide obtained by reacting lauric acid with hydroxyethyl ethylene diamine, lauryl amide obtained by reacting lauric acid with diethylene triamine, lauryl amide obtained by reacting lauric acid with triethylene tetramine, caprylamide obtained by reacting capric acid with diethanolamine, octylamide obtained by reacting octanoic acid with hydroxyethyl ethylene diamine, and N,N-dimethyl formamide, and the mixture thereof.

Preferably, the organic molybdenum additive of the present invention is prepared through steps as follows:

The organic molybdenum additive product is prepared by reacting the aforementioned reactants a, b and c in a weight-ratio of 49~99: 0.1~25: 0~50, preferably 50~90: 0.1~15: 0.1~50, and most preferably 50~90: 1~15: 1~30.

The additive prepared according to the present invention has an infrared characteristic absorption peak between 1600~1610 cm-1, different from the reactant.

Solvent may be added or may not be added during the preparation of the organic molybdenum additive of the present invention. When a solvent is added, the selected solvent to be added includes toluene, xylene, gasoline, water and/or the mixture thereof. If a solvent is added, the solvent may be removed out in a mode commonly known for one skilled in the art, for example, under condition of atmospheric pressure or reduced pressure after end of the reaction.

Said reaction temperature is between 60~160° C., preferably 100~130° C.

Said reaction time is between 1~10 hrs, preferably 2~6 hrs.

Said reaction is preferably carried out in an inert gas atmosphere, more preferably under nitrogen gas atmosphere.

In the organic molybdenum additive prepared according to the process according to the present invention, molybdenum content is 0.1~8.0% based on the total weight of said additive, preferably 2.0~7.0%.

The present invention further provides a lubricating composition containing aforementioned organic molybdenum additive together with further lubricating base oil. Said base oil may be mineral oil, vegetable oil or synthetic oil. Wherein the synthetic oil is Fisch-Tropsch synthetic oil, poly α-olefin synthetic oil or esters oil.

Aforementioned compositions may also contain other lubricant additives, such as, one or more specifies selected from the group consisting of antioxidant, detergent agent, dispersant agent, antirusting agent, antiwear additive, viscosity index improver, freezing point depressant. The antioxidant may be one selected from the group consisting of 2,6-di-tert-butyl p-cresol, benzotriazole derivatives, thiadiazole derivatives; the detergent agent may be one selected from the group consisting of petroleum sulfonate, synthetic sulfonate, alkyl salicylate, naphthenate or alkylphenolate sulfide; the dispersant agent may be one selected from the group consisting of succinimide, hydrocarbyl amines, multi-hydroxy succinates, hydrocarbyl substituted Mannich bases or hydrocarbyl substituted triazoles; the antirusting agent may be one selected from the group consisting of petroleum sulfonate, synthetic sulfonate, benzotriazole or alkyl imidazoline phosphate; the antiwear additive may be one selected from the group consisting of dialkyl dithiophosphate/ester, dithiocarbamate/ester, thiadiazole, tritolylphosphate, terpene sulfide or sulfurized fat oil; the viscosity index improver may be one selected from the group consisting of polymethacrylate, polyisobutylene, ethylene-propene copolymer or styrene-isoprene polymer; the freezing point depressant may be one selected from the group consisting of alkyl naphthalene, polymethacrylate, poly α-olefin, polyethylene-co-fumarate or vinyl acetate-co-fumarate polymer.

As it is required, aforementioned composition may also contain other additive that may be used as lubricant additive.

The organic molybdenum additive according to the present invention has excellent properties of antiwear and antifriction.

Obviously, various modifications and variations may be made by persons of skill in the art without violating the key concept and scope of the present invention. The technical solutions from these modifications and variations are all within the scope of the present invention. Examples of the present invention are used only as an illustrating example, and the real scope and concept of the present invention are pointed out in claims of the present application.

Following examples are intended to illustrate further the process of the present invention.

EXAMPLE 1

To a 250 ml four-neck flask equipped with a stirrer, a thermometer, a reflex condenser and a feeder, 1 g dibutylamine (chemical pure), 40 g F10A lubricant additive (manufactured by CIBA Corp, with main constituent of glyceride of 3,5-di-tert-butyl p-hydroxybenzene propionic acid) and 90 ml of toluene were added and the temperature was raised to 70~80° C. under nitrogen gas atmosphere. An aqueous solution prepared from 6 g ammonium paramolybdate (chemical pure) and 20 ml distilled water was added in droplet and the resulting mixture was reacted under refluxing at 100° C. for 6 hrs. The organic molybdenum lubricant additive M-02 was obtained by evaporating out toluene and filtering slag off from the reacted mixture, wherein the molybdenum content was 3.04% based on the total weight of said organic molybdenum additive.

EXAMPLE 2

To a 250 ml three-neck flask equipped with a stirrer and a thermometer, 40 g F10A lubricant additive, 15 g of coco trimethylene diamine (industrial grade, Jiangsu Feixiang Corp.) were added and the temperature was raised to 70~80° C. under nitrogen gas atmosphere. 6 g molybdenum trioxide (reagent in chemical pure) was added and then the resulting mixture was reacted at 120° C. for 6 hrs, with the water formed being removed. The organic molybdenum lubricant additive N-02 was obtained, wherein the molybdenum content was 6.92% based on the total weight of said organic molybdenum additive.

EXAMPLE 3

To a 250 ml four-neck flask identical to that in Example 1, 35 g diglyceride of 3,5-di-tert-butyl p-hydroxybenzene propionic acid and oleic acid, which was synthesized according to U.S. Pat. No. 6,046,263, 80 ml toluene and 12 g N-oleyl di(trimethylene) triamine, (industrial grade, Jiangsu Feixiang Corp) were added and the temperature was raised to 70~80° C. under nitrogen gas atmosphere, An aqueous solution prepared from 6 g ammonium paramolybdate (chemical pure) with 20 ml distilled water was added in droplet and the resulting rupture was reacted under refluxing at 110° C. for 3 hrs. The organic molybdenum lubricant additive N-03 was obtained by evaporating out toluene and not forming slag till the reaction was ended, wherein the molybdenum content was 6.42% based on the total weight of said organic molybdenum lubricant additive.

EXAMPLE 4

To a 250 ml four-neck flask identical to that in Example 1, 40 g pentaerythritol diester of 3,5-di-tert-butyl p-hydroxybenzene propionic acid and oleic acid, which was synthesized according to U.S. Pat. No. 6,046,263, 80 ml toluene and 1 g diphenylamine having a side chain with a carbon atom number of 8 on aromatic ring were added and the temperature was raised to 70~80° C. under nitrogen gas atmosphere. An aqueous solution prepared from 4 g ammonium molybdate (chemical pure) and 10 ml distilled water was added in droplet and the resulting mixture was reacted under refluxing at 120° C. for 2 hrs. The organic molybdenum lubricant additive M-05 of the present invention was obtained by evaporating out toluene and filtering slag off from the reacted mixture, wherein the molybdenum content was 1.03% based on the total weight of said organic molybdenum lubricant additive.

EXAMPLE 5

To a 250 ml four-neck flask identical to that in Example 1, 75 g of F10A, 20 g of stearyl amide prepared by reacting stearic acid with triethylene tetramine in a molar ratio 1:1 were added and the temperature was raised to 70~80° C. under nitrogen gas atmosphere. An aqueous solution prepared from adding 9.3 g ammonium paramolybdate with 20 ml distilled water was added in droplet and the resulting mixture was reacted at 130° C. for 4 hrs and no slag was formed till the reaction was ended. The organic molybdenum lubricant additive N-05 was obtained, wherein the molybdenum content was 5.41% based on the total weight of said organic molybdenum lubricant additive.

EXAMPLE 6

To a 250 ml of the four-neck flask identical to that in Example 1, 40 g diglyceride of 3,5-di-tert-butyl p-hydroxybenzene propionic acid and oleic acid, which was synthesized according to U.S. Pat. No. 6,046,263, 10 g oleoyl amide obtained by reacting oleic acid with hydroxyethyl ethylene diamine in a molar ratio 1:1 were added and the temperature was raised to 70~80° C. under nitrogen gas atmosphere. An aqueous solution prepared from 10 g ammonium molybdate and 20 ml distilled water was added in droplet and the resulting mixture was reacted at 110° C. for 4 hrs. The organic molybdenum additive M-07 was obtained by filtering slag off from the reacted mixture, wherein the molybdenum content was 5.35% based on the total weight of said organic molybdenum additive.

EXAMPLE 7

To a 250 ml four-neck flask identical to that in Example 1, 80 g F10A, 10 g laury amide obtained by reacting lauric acid with diethanolamine in a molar ratio 2:1 were added, and the temperature was raised to 70~80° C. under nitrogen gas atmosphere. The aqueous solution prepared from 10 g ammonium molybdate and 20 ml distilled water was added in droplet and the resulting mixture was reacted at 130° C. for 2 hrs. The organic molybdenum lubricant additive N-07 was obtained by filtering slag off from the reacted mixture, wherein the molybdenum content was 5.28% based on the total weight of said organic molybdenum lubricant additive.

EXAMPLE 8

To a 250 ml four-neck flask identical to that in Example 1, 40 g diglyceride of 3,5-di-tert-butyl p-hydroxybenzene propionic acid and stearic acid, which was synthesized according to U.S. Pat. No. 6,046,263, and 10 g octylamide obtained by reacting octanoic acid with diethylene triamine in a molar ratio 1:2 were added and the temperature was raised to 70~80° C. under nitrogen gas atmosphere. The aqueous solution prepared from 10 g ammonium molybdate and 20 ml distilled water was added in droplet and the resulting mixture was reacted at 110° C. for 4 hrs. The organic molybdenum lubricant additive N-08 was obtained by filtering slag off from the reacted mixture, wherein the molybdenum content was 5.09% based on the total weight of said organic molybdenum lubricant additive.

EXAMPLE 9

To a 250 ml four-neck flask identical to that in Example 1, 40 g mono glyceride of 3-tert-butyl-5-methyl p-hydroxybenzene propionic acid, which was synthesized according to U.S. Pat. No. 6,046,263, 80 ml toluene and 10 g N,N-dimethyl formamide (a reagent in chemical pure) were added and the temperature was raised to 70~80° C. under nitrogen gas atmosphere. An aqueous solution prepared from 5 g ammonium molybdate and 20 ml distilled water was added in droplet and the resulting mixture was reacted under refluxing at 120° C. for 4 hrs. The organic molybdenum lubricant M-01 was obtained by evaporating out toluene and filtering slag off from the reacted mixture, wherein the molybdenum content was 2.93% based on the total weight of said organic molybdenum lubricant additive.

EXAMPLE 10

To a 250 ml four-neck flask identical to that in Example 1, 40 g diglyceride of 3,5-di-tert-butyl p-hydroxybenzene propionic acid and oleic acid, which was synthesized according to U.S. Pat. No. 6,046,263, 80 ml toluene, 10 g coco trimethylene diamine, 2 g N,N-dimethyl formamide were added and the temperature was raised to 70~80° C. under nitrogen gas atmosphere. The aqueous solution prepared from 6 g ammonium molybdate and 20 ml distilled water was added in droplet and the resulting mixture was reacted under refluxing at 150° C. for 2 hrs. The organic molybdenum lubricant additive N-10 was obtained by evaporating out toluene and filtering slag off from the reacted mixture, wherein the molybdenum content was of 5.53% based on the total weight of said organic molybdenum lubricant additive.

EXAMPLE 11

To a 250 ml four-neck flask identical to that in Example 1, 6 g ammonium molybdate and 80 g distilled water were added, then 40 g F10A lubricant additive (manufactured by CIBA Corp, with main constituent of glyceride of 3,5-di-tert-butyl p-hydroxybenzene propionic acid) and 5 g N,N-dimethyl formamide were added, and the resulting mixture was reacted under refluxing under nitrogen gas atmosphere at 100° C. for 6 hrs. After the reaction was ended, the resultant product was deposited for layering to remove water phase. The organic molybdenum additive M-03 was obtained by evaporating out moisture remained in the oil phase and filtering slag off from the reacted mixture, wherein the molybdenum content was 2.67% based on the total weight of said organic molybdenum additive.

EXAMPLE 12

To a 250 ml four-neck flask identical to that in Example 1, 40 g diglyceride of 3,5-di-teit-butyl p-hydroxybenzene propionic acid and oleic acid, which was synthesized according to U.S. Pat. No. 6,046,263, 80 ml toluene, 10 g N,N-dimethyl formamide and 2 g dibutylamine were added and the temperature was raised to 70~80° C. under nitrogen gas atmosphere. An aqueous solution prepared from 8 g ammonium molybdate and 20 ml distilled water was added in droplet and the resulting mixture was reacted under refluxing at 110° C. for 2 hrs, The organic molybdenum additive M-04 was obtained by evaporating out toluene and filtering slag off from the reacted mixture, wherein the molybdenum content was 3.17% based on the total weight of said organic molybdenum additive.

EXAMPLE 13

To a 250 ml four-neck flask identical to that in Example 1, 40 g F10A lubricant additive and 80 ml toluene were added and the temperature was raised to 70~80° C. under nitrogen gas atmosphere. 3 g molybdenum trioxide was added and the resulting mixture was reacted under refluxing at 120° C. for 2 hrs. The organic molybdenum additive M-06 was obtained by evaporating out toluene and filtering slag off from the reacted mixture, wherein the molybdenum content was 0.24% based on the total weight of said organic molybdenum additive.

EXAMPLE 14

To a 250 ml four-neck flask identical to that in Example 1, 25 g diglyceride of 3,5-di-tert-butyl p-hydroxybenzene propionic acid and oleic acid, which was synthesized according to U.S. Pat. No. 6,046,263, 80 ml toluene, 20 g N,N-dimethyl formamide and 2 g dibutylamine were added and the temperature was raised to 70~80° C. under nitrogen gas atmosphere. The aqueous solution prepared from 6 g ammonium molybdate and 20 ml distilled water was added in droplet and the resulting mixture was reacted under refluxing at 110° C. for 3 hrs. The organic molybdenum additive M-08 was obtained by evaporating out toluene and no slag was formed during the reaction process, wherein the molybdenum content was 6.42% based on the total weight of said organic molybdenum lubricant additive.

EXAMPLE 15

To a 250 ml foul neck flask identical to that in Example 1, 20 g diglyceride of 3,5-di-tert-butyl p-hydroxybenzene propionic acid and stearic acid, which was synthesized according to U.S. Pat. No. 6,046,263, and 80 ml toluene and 15 g lauryl amide obtained by reacting lauric acid with diethanolamine in a molar ratio of 1:1 and 2 g dibutylamine were added and the temperature was raised to 70~80° C. under nitrogen gas atmosphere. The aqueous solution prepared from 10 g ammonium molybdate and 20 ml distilled water was added in droplet and the resulting mixture was reacted under refluxing at 130° C. for 4 hrs. The organic molybdenum additive M-09 was obtained by evaporating out toluene and filtering slag off from the reacted mixture, wherein the molybdenum content was 5.66% based on the total weight of said organic molybdenum additive.

EXAMPLE 16

Aforementioned organic molybdenum lubricant additives M-01, M-02, M-04 and M-08, and the additives used as control, i.e. F10A lubricant additive (manufactured by CIBA Corp), Van 855 lubricant additive (manufactured by VANDERBILT Corp, with an actually measured molybdenum content of 6.62%), and a composition compounded of F10A lubricant additive and Van 855 lubricant additive in an equal-weight ratio were added respectively into a 150SN base oil (I kind of oil) with the same dose according to the same formulation (ratio) as that of normal lubricant complex additive. Each of the organic molybdenum additives of the present invention and the control additives was added in the same quantity of 0.5%, and each of compounded lubrication systems was further added with 4.5% of SF gasoline engine oil as a composite agent (manufactured by Wuxi Southern Additive Corp.) respectively. Antiwear and antifriction property of each compounded system obtained was measured respectively by using a four-ball apparatus for assessing test of the antiwear and antifriction property (Industry Standard SH/T 0189-92). Test conditions were: a temperature of 75° C., a rotation rate of 1200 rpm, a load of 40 kg, and a testing time of 1 hr. Results are recorded in Table 1. The data given by the test with the four-ball apparatus for measuring antiwear and antifriction include friction coefficient and abraded spot diameter. The lower the abraded spot diameter and friction coefficient, the more excellent effect of antiwear and antifriction is.

TABLE 1

Testing results with four-ball apparatus for antiwear and antifriction property of the synthesized organic molybdenum and the compounded system in the Comparative Example

| | Result | |
|---|---|---|
| No. | Abraded spot diameter (mm) | Friction coefficient |
| F10A | 0.55 | 0.105 |
| Van 855 | 0.48 | 0.091 |
| F10A + Van 855 | 0.70 | 0.085 |
| M-01 | 0.44 | 0.068 |
| M-02 | 0.44 | 0.065 |
| M-04 | 0.45 | 0.070 |
| M-08 | 0.42 | 0.060 |

It can be seen from the results shown in Table 1 that the compounded systems containing the organic molybdenum additive of the present invention have less friction coefficientss and less abraded spot diameters than the systems of Comparative Examples, showing that the organic molybdenum lubricant additives according to the present invention are superior to the prior additives in terms of the properties of antiwear and antifriction.

EXAMPLE 17

The properties of antiwear and antifriction for each compounded lubrication system said below were measured according to the method as follows. Said method comprises using a SRV high frequency linear vibration tester to measure the properties of antiwear and antifriction under test conditions: a temperature of 80, a load of 300N, a testing time of 1 hr, a stroke of 1 mm and a frequency of 50 Hz. Friction pairs are in sphere contacting. Test results are given in friction coefficient and abraded spot diameter. The lower the value of the abraded spot diameter and friction coefficient, the more excellent result of correspondent antiwear and antifriction property is.

1. The compounded lubrication system was prepared as follows: hydrogenated base oils (100N and 150N hydrogenated base oil were blended in a weight-ratio of 2:3) was added respectively with 0.67% (as calculated according to the total weight of said compounded lubrication system) of aforementioned organic molybdenum additive M-02, N-03, M-057 M-07 and additives used as control including: lubricant additive F10A (manufactured by CIBA Corp.), Van 855 lubricant additive (manufactured by VANDERBILT Corp. with 6.62% of molybdenum content that was measured really), F10A compounded with Van 855 in an equal-weight ratio. Each of mixtures obtained above was added with 3% (as calculated on the total weight of said compounded lubrication system) of succinimide dispersant agent 152 (manufactured by Wuxi Southern Additive Corp), 0.5% (as calculated on the total weight of said compounded lubrication system) of 7169 (zinc dialkyl dithiophosphate, manufactured by Ethyl Corp), 0.3% (as calculated on the total weight of said compounded lubrication system) of L67 antioxidant (manufactured by CIBA Corp) and 2% (as calculated on the total weight of said compounded lubrication system) of alkyl benzene calcium sulfonate detergent agent 106 (manufactured by Wuxi Southern Additive Corp), each compounded lubrication system was obtained.

Table 2 shows SRV results measured by using the above method for each compounded lubrication system obtained in aforementioned 1.

TABLE 2

SRV results of the antiwear and antifriction property by testing in hydrogenated base oil

| Additive | Result: Abraded spot diameter (mm) | Result: Friction coefficient |
|---|---|---|
| F10 | 0.57 | 0.125 |
| 855 | 0.53 | 0.100 |
| F10A + 855 | 0.57 | 0.115 |
| M-02 | 0.52 | 0.090 |
| N-03 | 0.48 | 0.085 |
| M-05 | 0.53 | 0.098 |
| M-07 | 0.50 | 0.087 |

2. The compounded lubrication systems were prepared according to following method: Fisch-Tropsch lubricants (the viscosity at 100° C. was 5.89 centipoises) was added respectively with 0.5% (as calculated according to total weight of said compounded lubrication system) of aforementioned organic molybdenum additive M-02, N-03, M-05, M-07 and additives used as control, e.g. F10A lubricant additive (manufactured by CIBA Corp.), Van 866 (manufactured by VANDERBILT Corp, the molybdenum content measured was 6.62%), F10A compounded with Van 855 in an equal-weight ratio. Each of the mixtures obtained above was further added with 2% of succinimide dispersant agent 151 (manufactured by Wuxi Southern Additive Corp), 0.6% of 202 (zinc dialkyl dithiophosphate, manufactured by Liaoning Tianhe Fine Chemical Corporation) and 0.5% of L57 antioxidant (manufactured by CIBA Corp.) and 0.5% of alkyl benzene calcium sulfonate detergent agent 106 (manufactured by Wuxi Southern Additive Corp), each of the compounded lubrication system was obtained.

Table 3 shows SRV test results measured by the above method for each compounded lubrication system prepared in aforementioned 2.

TABLE 3

SRV test results of antiwear and antifriction property by testing in Fisch-Tropsch synthetic lubricant oil

| Additive | result: Abraded spot diameter (mm) | result: Friction coefficient |
|---|---|---|
| F10 | 0.51 | 0.116 |
| 855 | 0.50 | 0.093 |
| F10A + 855 | 0.50 | 0.102 |
| M-02 | 0.48 | 0.087 |
| N-03 | 0.45 | 0.083 |
| M-05 | 0.49 | 0.092 |
| M-07 | 0.46 | 0.084 |

It can be seen from test results shown in Table 2 and Table 3 that in different lubricant oils or different additive formulation systems, the compounded systems containing the organic molybdenum additive of the present invention have less friction coefficients and abraded spot diameters than those of Comparative Examples, showing that the organic molybdenum additives according to the present invention have a superior antiwear and antifriction property than those in the prior art.

The invention claimed is:

1. An organic molybdenum additive, wherein said organic molybdenum additive is a reaction product of the following components:

a. polyol ester of p-hydroxybenzene alkyl acid, which is selected from the following structural formulas:

(I)

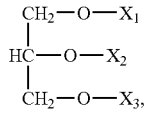

(II)

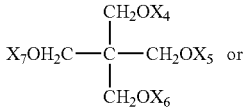

(III)

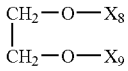

wherein at least one of $X_1$, $X_2$, and $X_3$ is a group of structural formula (a), at least one of $X_4$, $X_5$, $X_6$ and $X_7$ is a group of structural formula (a), at least one of $X_8$ and $X_9$ is a group of structural formula (a), the remaining groups may be the same or different and are independently selected from the group consisting of H atom, the group of structural formula (a), and the group of structural formula (b);

(a)

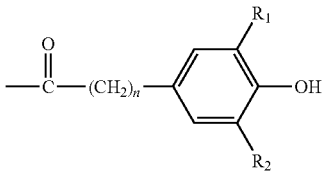

(b)

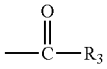

wherein $R_1$ and $R_2$ are tert-butyl; n is an integer of 2-12, and $R_3$ is H or a saturated or unsaturated hydrocarbyl group having a carbon number of 1-30, b. an inorganic molybdenum compound, and c. an aliphatic amine, an amide, or a mixture thereof, wherein said aliphatic amine is a primary amine or alkylene diamine having a carbon atom number from 4-30 and amino number of 1-5, or a mixture thereof; and said amide is selected from amides obtained by reacting a fatty acid having a carbon atom number of 1-30 with an organic amine having an amino number of 1-5 and a carbon atom number of 1-12, or aqua ammonia.

2. The organic molybdenum additive according to claim 1, wherein said polyol is an alcohol with a carbon atom number of 2-12 and a hydroxyl number of 2-5.

3. The organic molybdenum additive according to claim 1, wherein n is an integer of 2-8, and $R_3$ is a saturated or unsaturated hydrocarbyl group having a carbon atom number of 5-20.

4. The organic molybdenum additive according to claim 3, wherein n is 2, 3 or 4, and $R_3$ is a saturated or unsaturated hydrocarbyl group having a carbon atom number of 10-18.

5. The organic molybdenum additive according to claim 2, wherein said polyol ester of p-hydroxybenzene alkyl acid is selected from the group consisting of:

monoglyceride of 3,5-di-tert-butyl p-hydroxybenzene propionic acid, diglyceride of 3,5-di-tert-butyl p-hydroxybenzene propionic acid, triglyceride of 3,5-di-tert-butyl p-hydroxybenzene propionic acid, monopentaerythritol ester of 3,5-di-tert-butyl p-hydroxybenzene propionic acid, pentaerythritol diester of 3,5-di-tert-butyl p-hydroxybenzene propionic acid, pentaerythritol triester of 3,5-tert-butyl p-hydroxybenzene propionic acid, pentaerythritol tetraester of 3,5-di-tert-butyl p-hydroxybenzene propionic acid, monoglycol ester of 3,5-di-tert-butyl p-hydroxybenzene propionic acid, ethylene glycol diester of 3,5-di-tert-butyl p-hydroxybenzene propionic acid (a compound of structural formula III, wherein, both $X_8$ and $X_9$ are groups selected from group represented by structural formula (a) in which n is 2 and both $R_1$ and $R_2$ are tert-butyl), diglyceride of 3,5-di-tert-butyl p-hydroxybenzene propionic acid and oleic acid, diglyceride of 3,5-di-tert-butyl p-hydroxybenzene propionic acid and stearic acid, diglyceride of 3,5-di-tert-butyl p-hydroxybenzene propionic acid and lauric acid, diglyceride of 3,5-di-tert-butyl p-hydroxybenzene propionic acid and myristic acid, diglyceride of lauric acid, diglyceride of 3,5-di-tert-butyl p-hydroxybenzene propionic acid and palmitic acid, triglyceride of 3,5-di-tert-butyl p-hydroxybenzene propionic acid, oleic acid and stearic acid, triglyceride of 3,5-di-tert-butyl p-hydroxybenzene propionic acid and distearic acids, triglyceride of 3,5-di-tert-butyl p-hydroxybenzene propionic acid and dilauric acids, triglyceride of 3,5-di-tert-butyl p-hydroxybenzene propionic acid and dipalmitic acids, triglyceride of 3,5-di-tert-butyl p-hydroxybenzene propionic acid, lauric acid and stearic acid, triglyceride of 3,5-di-tert-butyl p-hydroxybenzene propionic acid, palmitic acid and stearic acid, triglyceride of 3,5-di-tert-butyl p-hydroxybenzene propionic acid, myristic acid and stearic acid, pentaerythritol diester of 3,5-di-tert-butyl p-hydroxybenzene propionic acid and oleic acid, pentaerythritol diester of 3,5-di-tert-butyl p-hydroxybenzene propionic acid and stearic acid, pentaerythritol diester of 3,5-di-tert-butyl p-hydroxybenzene propionic acid and lauric acid, pentaerythritol diester of 3,5-di-tert-butyl p-hydroxybenzene propionic acid and myristic acid, pentaerythritol diester of 3,5-di-tert-butyl p-hydroxybenzene propionic acid and palmitic acid, pentaerythritol triester of 3,5-di-tert-butyl p-hydroxybenzene propionic acid, lauric acid and stearic acid, pentaerythritol triester of 3,5-di-tert-butyl p-hydroxybenzene propionic acid, oleic acid and stearic acid, pentaerythritol triester of 3,5-di-tert-butyl p-hydroxybenzene propionic acid and palmitic acid and stearic acid, pentaerythritol triester of 3,5-di-tert-butyl p-hydroxybenzene propionic acid and distearic acids, pentaerythritol tetraester of 3,5-di-tert-butyl p-hydroxybenzene propionic acid, oleic acid and distearic acids, glycol ester of 3,5-di-tert-butyl p-hydroxybenzene propionic acid and stearic acid, and mixtures thereof.

6. The organic molybdenum additive according to claim 1, wherein said inorganic molybdenum compound is selected from the group consisting of ammonium molybdate, ammonium paramolybdate, sodium molybdate, molybdenum trioxide, and mixtures thereof.

7. The organic molybdenum additive according to claim 1, wherein said aliphatic amine is selected from the group consisting of primary amines having a carbon atom number from 4-25 and amino number of 1-4, and mono-alkylated alkylene diamine derived from a fatty acid with a carbon atom number of 12-18, and mixtures thereof; said amide is selected from amides obtained by reacting a fatty acid having a carbon atom number of 12-18 with an organic amine selected from diethanolamine, hydroxyethyl ethylene diamine, diethylene triamine, triethylene tetramine, tetraethylene pentamine, dipropylene triamine, tripropylene tetramine, tetrapropylene pentamine, and mixtures thereof in a ratio of 2:1 to 1:2.

8. The organic molybdenum additive according to claim 1, wherein said aliphatic amine is selected from the group consisting of butyl amine, hexyl amine, octyl amine, lauryl amine, cetyl amine, stearyl amine, dodecyl ethylene diamine, dodecyl trimethylene diamine, hexadecyl ethylene diamine, hexadecyl trimethylene diamine, octadecyl ethylene diamine, octadecyl trimethylene diamine, coco trimethylene diamine, tallow trimethylene diamine, oleyl trimethylene diamine, and mixtures thereof.

9. The organic molybdenum additive according to claim 1, wherein said amide is selected from the group consisting of stearyl amide obtained by reacting stearic acid with diethanolamine, stearyl amide obtained by reacting stearic acid with hydroxyethyl ethylene diamine, stearyl amide obtained by reacting stearic acid with diethylene triamine, stearyl amide obtained by reacting stearic acid with triethylene tetramine, oleic acid amide obtained by reacting oleic acid with diethanolamine, oleic acid amide obtained by reacting oleic acid with hydroxyethyl ethylene diamine, oleic acid amide obtained by oleic acid with diethylene triamine, oleic acid amide obtained by reacting oleic acid with triethylene tetramine, palmityl amide obtained by reacting palmitic acid with diethanolamine, palmityl amide obtained by reacting palmitic acid with hydroxyethyl ethylene diamine, palmityl amide obtained by reacting palmitic acid with diethylene triamine, palmityl amide obtained by reacting palmitic acid with triethylene tetramine, myristic acid amide obtained by reacting myristic acid with diethanolamine, myristyl amide obtained by reacting myristic acid with hydroxyethyl ethylene diamine, myristyl amide obtained by reacting myristic acid with diethylene triamine, myristyl amide obtained by reacting myristic acid with triethylene tetramine, lauryl amide obtained by reacting lauric acid with diethanolamine, lauryl amide obtained by reacting lauric acid with hydroxyethyl ethylene diamine, lauryl amide obtained by reacting lauric acid with diethylene triamine, lauryl amide obtained by reacting lauric acid with triethylene tetramine, capryl amide obtained by capric acid with diethanolamine, octyl amide obtained by reacting octanoic acid with hydroxyethyl ethylene diamine, and mixtures thereof.

10. The organic molybdenum additive according to claim 1, wherein the weight-ratio of reactant a, b and c is 49~99: 0.1~25: 0~50.

11. The organic molybdenum additive according to claim 10, wherein the weight-ratio of reactant a, b and c is 50~90: 0.1~15: 0.1~50.

12. The organic molybdenum additive according to claim 10, wherein the weight-ratio of reactants a, b and c is 50~90: 1~15: 1~30.

13. The organic molybdenum additive according to claim 1, wherein the molybdenum content of the additive obtained is 0.1~8.0% based on the total weight of said additive.

14. The organic molybdenum additive according to claim 8, wherein the molybdenum content of the additive obtained is 2.0~7.0%.

15. The organic molybdenum additive according to claim 1, wherein said additive has an infrared characteristic absorption peak at 1600~1610 $cm^{-1}$, which is different from those of reactants.

16. A method for preparing an organic molybdenum additive, the method comprising reacting the following components:

a. polyol ester of p-hydroxybenzene alkyl acid, which is selected from the following structural formulas:

(I)

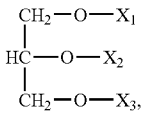

(II)

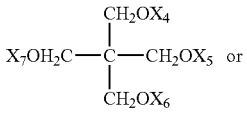

(III)

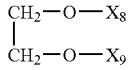

wherein at least one of $X_1$, $X_2$ and $X_3$ is a group of structural formula (a), at least one of $X_4$, $X_5$, $X_6$ and $X_7$ is a group of structural formula (a), at least one of $X_8$ and $X_9$ is a group of structural formula (a), the remaining groups may be the same or different and are independently selected from the group consisting of H atom, the group of structural formula (a), and the group of structural formula (b);

(a)

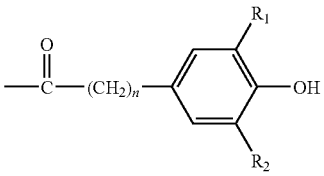

(b)

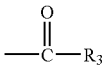

wherein $R_1$ and $R_2$ are tert-butyl; n is an integer of 2-12; and $R_3$ is H or a saturated or unsaturated hydrocarbyl group having a carbon number of 1-30, b. an inorganic molybdenum compound, and c. an aliphatic amine, an amide, or a mixture thereof, wherein said aliphatic amine is a primary amine or alkylene diamine having a carbon atom number from 4-30 and amino number of 1-5, or a mixture thereof; and said amide is selected from amides obtained by reacting a fatty acid having a carbon atom number of 1-30 with an organic amine having an amino number of 1-5 and a carbon atom number of 1-12, or aqua ammonia.

17. The method according to claim 16, wherein a solvent selected from the group consisting of toluene, xylene, gasoline, water, and mixtures thereof is included in the reaction.

18. The method according to claim 16, wherein the reaction temperature is 60~160° C. and the reaction time is 1~10 hrs.

19. The method according to claim 18, wherein the components are reacted at a reaction temperature of 100~130° C. for a reaction time of 2~6 hrs.

20. The method according to claim 16, wherein the reaction is conducted under an inert-gas atomosphere.

21. The method according to claim 20, wherein said inert gas is nitrogen gas.

22. A lubricant composition comprising an organic molybdenum additive according to claim 1.

23. The lubricant composition according to claim 22, wherein said lubricant composition is further comprised of lubricating base oil selected from mineral oils, vegetable oils, and synthetic oils.

24. The lubricant composition according to claim 23, wherein said synthetic oil is selected from Fisch-Tropsch oil, polyα-olefin synthetic oils, and ester oils.

25. The lubricant composition according to claim 22, wherein said composition further contains one or more other lubricant additives selected from antioxidant, detergent agent, dispersant agent, antirusting agent, antiwear additive, viscosity index improver, and freezing point depressant.

26. The lubricant composition according to claim 25, wherein the antioxidant is selected from the group consisting of 2,6-di-tert-butyl p-cresol, benzotriazole derivative, and thiadiazole derivative; the detergent agent is selected from the group consisting of petroleum sulfonate, synthetic sulfonate, alkyl salicylate, naphthenate, and alkyl-phenolate sulfide; the dispersant agent is selected from the group consisting of succinimide, hydrocarbyl amine, multi-hydroxy succinate, hydrocarbyl substituted Mannich base, and hydrocarbyl substituted triazole; the antirusting agent is selected from the group consisting of petroleum sulfonate, synthetic sulfonate, benzotriazole, and alkyl imidazoline phosphate; the antiwear additive is selected from the group consisting of dialkyl dithiophosphate(/ester), dithiocarbamate(/ester), thiadiazole, tritolyl phosphate, terpene sulfide, and sulfurized fat oil; the viscosity index improver is selected from the group consisting of polymethacrylate, polyisobutylene, ethylene-propylene copolymer, and styrene-isoprene polymer; the freezing point depressant is selected from the group consisting of alkyl naphthalene, polymethacrylate, polyα-olefine, polyethylene-fumaric acid copolymer, and vinyl acetate-fumarate copolymer.

27. The lubricant composition according to claim 22, wherein said lubricant composition is formulated as engine lubricating oil, gear oil, hydraulic oil, oils for metal working, or as lubricant grease.

* * * * *